US011357273B2

(12) United States Patent
Cloyd

(10) Patent No.: US 11,357,273 B2
(45) Date of Patent: Jun. 14, 2022

(54) CONVERTIBLE HEAD GARMENT

(71) Applicant: Travis Cloyd, Miami, FL (US)

(72) Inventor: Travis Cloyd, Miami, FL (US)

(73) Assignee: THE FLORIDA INTERNATIONAL UNIVERSITY BOARD OF TRUSTEES, Miami, FL (US)

( * ) Notice: Subject to any disclaimer, the term of this patent is extended or adjusted under 35 U.S.C. 154(b) by 50 days.

(21) Appl. No.: 16/913,239

(22) Filed: Jun. 26, 2020

(65) Prior Publication Data

US 2021/0401089 A1 Dec. 30, 2021

(51) Int. Cl.

| | |
|---|---|
| ***A41D 13/11*** | (2006.01) |
| ***A42B 1/02*** | (2006.01) |
| ***A42B 1/006*** | (2021.01) |

(52) U.S. Cl.

CPC ..... *A41D 13/1192* (2013.01); *A42B 1/006* (2013.01); *A42B 1/02* (2013.01); *A41D 2300/30* (2013.01)

(58) Field of Classification Search

CPC ..... A42B 1/004; A42B 1/006; A42B 1/00; A42B 1/0184; A42B 1/201; A42B 1/206

See application file for complete search history.

(56) References Cited

U.S. PATENT DOCUMENTS

| | | | | |
|---|---|---|---|---|
| 1,134,515 | A * | 4/1915 | Cohoon, Jr. | A42B 1/06 D2/893 |
| 1,485,160 | A * | 2/1924 | Bassan | A61F 9/02 128/201.24 |
| 4,593,417 | A * | 6/1986 | Brown, Jr. | A42B 1/045 2/205 |
| 5,035,004 | A * | 7/1991 | Koester | G09F 21/02 2/9 |
| 6,941,581 | B1 * | 9/2005 | England | A42B 1/22 2/195.2 |
| 7,240,372 | B2 * | 7/2007 | Larson | A42B 1/24 2/173 |
| 8,621,668 | B1 * | 1/2014 | Nolz | A42B 5/00 2/171.4 |
| 9,439,466 | B2 * | 9/2016 | Woo | A42B 1/0182 |
| 10,736,369 | B2 * | 8/2020 | Shaw | A42B 7/00 |
| 10,827,793 | B2 * | 11/2020 | Lee | A41G 7/00 |
| 2006/0070160 | A1 * | 4/2006 | Reitz | A42B 1/24 2/9 |
| 2007/0192934 | A1 * | 8/2007 | Niedrich | A42B 1/0184 2/171 |
| 2013/0333095 | A1 * | 12/2013 | Dudick | A42B 1/248 2/209.12 |
| 2019/0059492 | A1 * | 2/2019 | Grammer | A42B 1/206 |

* cited by examiner

*Primary Examiner* — F Griffin Hall
(74) *Attorney, Agent, or Firm* — Saliwanchik, Lloyd & Eisenschenk

(57) ABSTRACT

Caps that are capable of being converted into protective face masks are provided. A cap can include a crown that can be placed over the face and that can be at least partially disconnected to provide a viewing aperture, and overlapping layers that cover the mouth and nose. The headband of the cap can be converted to straps for securing around the head. A visor can be configured to shade the eyes in both the cap configuration and the face mask configuration. A one-way breathing valve can be included in the crown to assist with breathing when the face mask is worn.

19 Claims, 3 Drawing Sheets

CONVERTIBLE HEAD GARMENT

BACKGROUND

The recent COVID-19 pandemic has created an increasing need for face masks that can be worn for protection and when social distancing is not possible. There are a myriad of face masks available in a variety of configurations, for use by the general public. It is conceivable that many people will continue to use a face mask at least some of the time for general protection. This will require new and more convenient ways to carry and store face masks on the person quick deployment.

It would be helpful if items or devices that are typically carried or worn could be easily and quickly converted into a reusable face mask. This can be more convenient, reduce waste caused by one-time use masks, and can ensure adherence to mandatory protocols that require wearing a protective face mask in public spaces.

BRIEF SUMMARY

Embodiments of the subject invention solve the problem of providing a face mask that is easily and quickly accessible with head garment that can be converted to a safe and effective face mask. Head garments such as caps and hats with a soft cloth crown and a rigid or semi-rigid visor, often referred to as a "baseball cap," are a ubiquitous accessory in outdoor clothing. They typically have a round cap portion comprising multiple attached sections, held together at the top of the crown by a top button, an adjustable head band around the bottom of the crown, and a visor attached partially around the crown to protect or shade the eyes. The embodiments of the subject invention utilize devices and methods for converting or reforming a cap to provide a temporary protective face mask that can be adjusted to a user and that can be reconverted into a cap when not in use.

With embodiments of the subject invention, a convertible cap has a crown with one or more front sections and a head band that can be fully or partially removed or disconnected. When the one or more front sections are removed or disconnected, a viewing aperture is provided between one or more rear sections of the cap and the visor. The cap can then be turned and placed with the interior of the cap over the face with the aperture in front of the eyes. The remaining sections create a covering over the mouth and nose. The visor or bill of the cap can be flipped or bent downwards, so that it can be position to shade or protect the eyes. The headband can also be disconnected at least partially to provide straps for securing the face mask to the head.

The one or more front section that were removed can be replaced on the cap, so that they drape over and/or overlap the rear sections and assist in covering the nose and mouth. This can provide an extra layer of protection and a convenient place for holding or storing the one or more front section. The top button, typically used to secure and cover the point at the top of the crown where the sections come together, can be replaced with a one-way valve that allows exhaled air to pass, but inhibits inhalation. This can be beneficial in reducing the intake of gases, noxious smells, pollen, smoke, dust, and other harmful or undesirable particles. It can also inhibit fogging of glasses.

In an embodiment, a (convertible) head garment can comprise a cap configuration having a crown and a headband configured to be disconnected and reconnected to provide a face mask configuration, adapted to be securable over a nose and a mouth of a wearer for breathing. The crown and the headband can be at least partially disconnectable and reconnectable to provide the face mask configuration having a viewing aperture, configured to be placed in front of eyes of the wearer, and straps configured to secure the face mask configuration over the nose and the mouth. The head garment can further comprise: at least one front section that is at least partially disconnectable and configured to be placed over at least one rear section to provide the viewing aperture; a visor having a topside and an underside that can be reversed in position when the cap configuration is configured as a face mask configuration to provide a visor over the viewing aperture; at least one connecting component that facilitates disconnection and reconnection of the cap configuration into the face mask configuration and that facilitates disconnection and reconnection of the face mask configuration into the cap configuration; and/or a valve (e.g., a one-way breathing valve).

In another embodiment, a cap configurable as a face mask can comprise: a crown comprising at least one front section being disconnectable for overlapping at least one rear section of the crown and providing a viewing aperture; a head band around and disconnectable from a bottom of the crown to provide straps; a visor having a topside and a bottomside and arranged below the at least one front section; and a valve (e.g., a one-way breathing valve) at a top of the cap. The at least one front section can be at least partially removable from the at least one rear section such that the at least one front section flips over the at least one rear section. The at least one front section can be completely removable from the at least one rear section and reattachable over the at least one rear section.

In another embodiment, a method for converting a cap to a face mask can comprise: providing a cap as disclosed herein (e.g., a cap as disclosed in the previous paragraph); disconnecting the at least one front section at least partially from the at least one rear section to provide the viewing aperture; positioning the at least one front section to at least partially cover the at least one rear section; disconnecting the headband from the crown to provide the straps for securing around a head of a wearer; and bending or rotating the visor towards the viewing aperture, such that when the cap is converted to the face mask, the face mask is worn with the viewing aperture in front of eyes of the wearer and the visor extending over the viewing aperture, with the overlapping at least one front section and at least one rear section positioned over a nose and a mouth of the wearer and the valve in front of the nose and the mouth. The disconnecting of the at least one front section at least partially from the at least one rear section can comprise partially disconnecting the at least one front section from the at least one rear section and folding the at least one front section to overlap the at least one rear section. The disconnecting of the at least one front section at least partially from the at least one rear section can comprise completely disconnecting from the one or more rear section, and the method can further comprise reconnecting the at least one front section to overlap the at least one rear section. The disconnecting of the headband from the crown to provide the straps can comprise disconnecting the headband from the crown to form the straps that are attached to the crown such that, when secured to the head, the straps are above ears of the wearer. The method can further comprise: reattaching the straps to the bottom of the crown to reform the headband; disconnecting the at least one front section from overlapping the at least one rear section; reconnecting the at least one front section to the at least one rear section to close the viewing aperture; and bending or rotating the visor to extend out from the reconnected at least one front section, such that the face mask is converted back to the cap. The reconnecting of the at least one front section to the at least one rear section to close the viewing aperture can comprise folding the at least one front section over the viewing aperture. The reconnecting of the at least one front section to the at least one rear section to close the viewing aperture can comprise completely disconnecting the at least one front section and reconnecting the at least one front section to cover the viewing aperture. The straps can overlap an adjustment cut-out and can be used to adjust a size of the cap. The method can further comprise treating the cap with an anti-microbial agent.

BRIEF DESCRIPTION OF DRAWINGS

In order that a more precise understanding of the above recited invention can be obtained, a more particular description of the invention briefly described above will be rendered by reference to specific embodiments thereof that are illustrated in the appended drawings. The drawings presented herein may not be drawn to scale and any reference to dimensions in the drawings or the following description is specific to the embodiments disclosed. Any variations of these dimensions that will allow the subject invention to function for its intended purpose are considered to be within the scope of the subject invention. Thus, understanding that these drawings depict only typical embodiments of the invention and are not therefore to be considered as limiting in scope, the invention will be described and explained with additional specificity and detail through the use of the accompanying drawings in which.

DETAILED DESCRIPTION

Figure 1A:
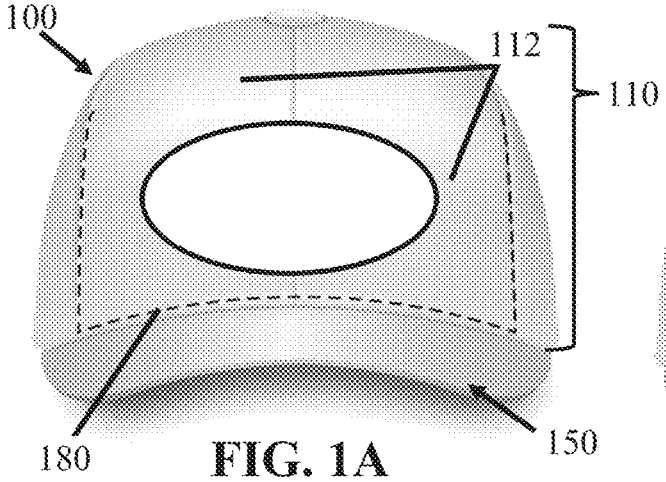
FIGS. 1A and 1B illustrate front views of a convertible cap, according to an embodiment of the subject invention, with one or more foldable front sections (FIG. 1A) and one or more removable front sections (FIG. 1B), indicated by dashed lines.

Embodiments of the subject invention provide head garments, such as hats or caps, which is convertible into a protective face mask. For example, a cap with a visor, such as a baseball cap, or similar garment, can be converted into a face mask for temporary use and can be easily reconverted into the wearable cap. The head garment can comprise one or more materials that can be treated with an anti-microbial substance for repeated use.

The following description will disclose that embodiments of the subject invention are particularly useful in the field of wearable head garment items, in particular hats or caps. While the embodiments herein are described in relation to a baseball cap type of head garment, the invention is not limited to this type of hat or cap. A person of skill in the art will understand that other types of hats, caps, or headwear can be amenable to modification according to the embodiments of the subject invention. Such variations which provide the same functionality, in substantially the way as described herein, with substantially the same desired results, are within the scope of this invention.

As used herein the term "cap" refers to any garment or item of clothing that can be worn on the head that comprises a shape conducive to being alternatively placed over the nose and mouth, as described herein. Thus, while the embodiments are described and shown herein with regard to a style of cap referred to commonly as a baseball cap, embodiments of the subject invention are not limited to only that particular type of cap or item.

As used herein, the term "substantially" refers to the complete or nearly complete extent or degree of an action, characteristic, property, state, structure, item, or result. For example, an object that is "substantially" in a given position including but not limited to vertical, horizontal, or adjacent to or aligned with another object, would mean that the object is either completely in that position or nearly completely in that position. The exact allowable degree of deviation from absolute completeness may in some cases depend on the specific context. However, generally speaking the nearness of completion will be so as to have the same overall result as if absolute and total completion were obtained.

As used herein, terms indicating relative direction or orientation, including but not limited to "upper", "lower", "top", "bottom", "vertical", "horizontal", "outer", "inner", "front", "back", "side", and the like, are intended to facilitate description of embodiments the present invention by indicating relative orientation or direction in usual use, and are not intended to limit the scope of the present invention.

Also, as used herein, and unless otherwise specifically stated, the terms "operable communication," "operable connection," "operably connected," "cooperatively engaged"

and grammatical variations thereof mean that the particular elements are connected in such a way that they cooperate to achieve their intended function or functions. The "connection" or "engagement" may be direct, or indirect, physical or remote.

It is to be understood that the figures and descriptions of embodiments of the present invention have been simplified to illustrate elements that are relevant for a clear understanding of the invention, while eliminating, for purposes of clarity, other elements that may be well known. Those of ordinary skill in the art will recognize that other elements may be desirable and/or required in order to implement the present invention. However, because such elements are well known in the art, and because they do not facilitate a better understanding of the present invention, a discussion of such elements is not provided herein.

Reference will be made to the attached Figures on which the same reference numerals are used throughout to indicate the same or similar components. With reference to the attached Figures, which show certain embodiments of the subject invention, it can be seen that a cap 100 can be configured or converted to a face mask 200. The cap can have a crown 110 with one or more front section 112 and one or more rear section 114, where one or more of the front sections can be fully or partially removed from the crown. Around the bottom of the crown there can be an at least partially removable head band 130 and a visor 150 that protects or shades the eyes. There can also be a valve 170 at or about the top of the crown that can serve dually as a top button, to secure and cover where the front and rear sections are joined at the top of the cap and also assist in breathing when the cap is converted to a protective face mask. Multiple connecting components 180 can be utilized at various locations on the cap to facilitate disconnection and reattachment of the various components of the cap when converted to a face mask. Each of these general components can have one or more sub-components, which will be discussed in detail below.

A convertible cap 100, such as shown in FIG. 1, can have a crown 110 comprising at least one front section 112 and at least one rear section 114 that form an interior 105 of the cap. The one or more front and one or more rear sections can be joined so that they meet at the top of the cap. In one embodiment, the front and rear sections meet at the top of the crown to form an outlet 175 in which a breathing valve 170 can be placed, such as shown, for example, in FIGS. 6 and 7.

Figure 7:
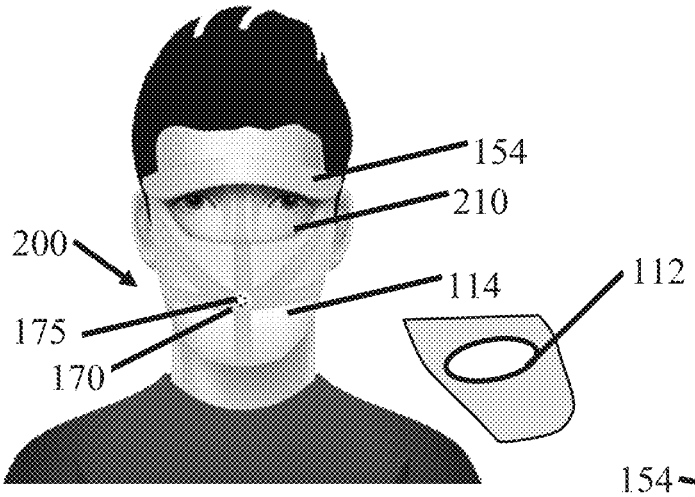
FIG. 7 illustrates one method for positioning a convertible cap, according to an embodiment of the subject invention, against the face. With this embodiment, the front sections are fully removable, but are shown here not yet reattached. It can be seen how the one-way valve at the top of the crown is positioned over the nose and mouth when converted to a face mask. The front sections can be replaced to cover the back sections over the face to provide a second layer of protection.

One-way breathing valves are commonly used on N95 and other types of protective face masks. Such valves are advantageous in allowing for exhalation through such masks, which can increase comfort. They can also inhibit inhalation of undesirable particles, odors, microbes, etc. A cap 100 of embodiments of the subject invention can also utilize a one-way breathing valve. In one embodiment, a breathing valve is secured within the outlet 175 formed at the top of the cap by the front sections 112 and rear sections 114. FIG. 7 shows a non-limiting example of a breathing valve arranged at the top of a cap.

Figure 2:
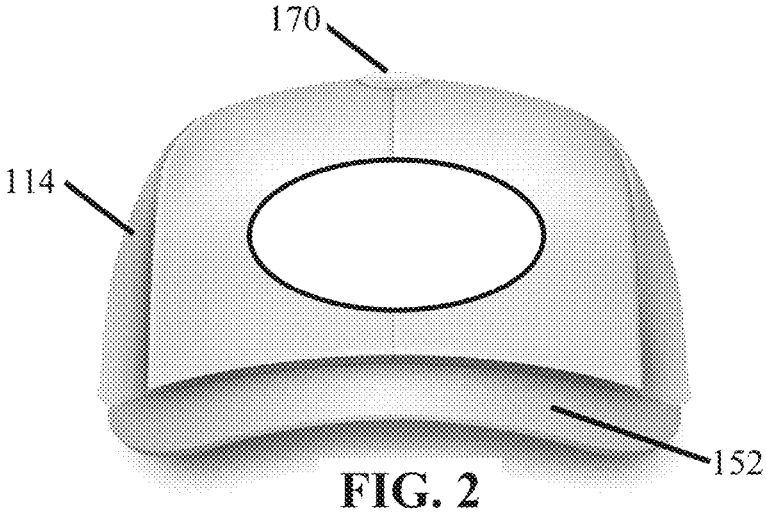
FIG. 2 illustrates a front view of a convertible cap, according to an embodiment of the subject invention, with the one or more front sections being disconnected near the visor.

At the front of the cap 100 there can be a visor 150 that extends out and away at a distance from the front and bottom end of the crown. The visor can protect and shade the eyes when the cap is worn on the head. The visor can have a top side 152 and an underside 154. As will be described further below, the top side and underside can reverse positions when the cap is converted to a face mask. In one embodiment, the visor has a curvature, which is shown, for example, in FIG. 2 that can be reversible so that when the cap is converted to a face mask, the curve of the visor can also be reversed so as to continue to protect and shade the eyes, such as shown, for example, in FIG. 8. Any suitable material can be employed to provide a reversible visor. For example, flexible metal inserts or wires can be used that can be reshaped into the desired curvature for each configuration. Tension on the visor when secured to the head can also operate to changer the curvature of the visor. Various plastics also provide sufficient flexibility to be adjusted to different shapes. A person of skill in the art can determine an appropriate material for a reversible visor.

Figure 3:
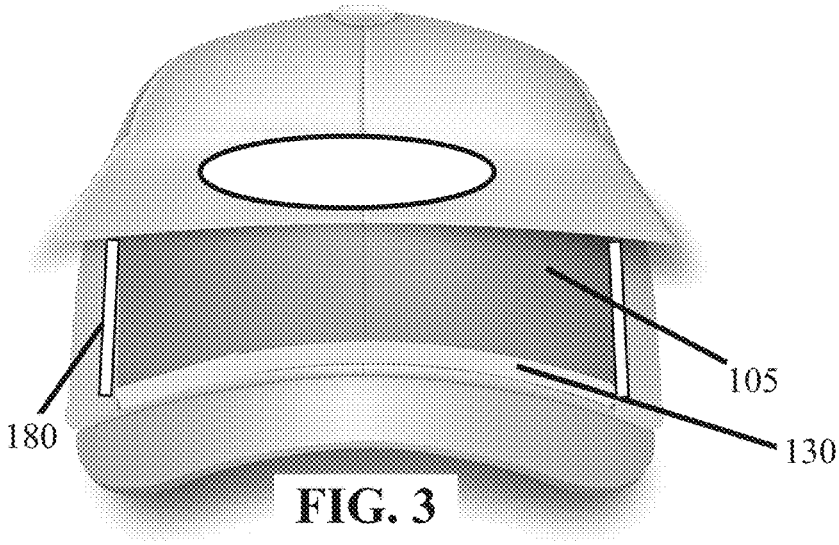
FIG. 3 illustrates a front view of a convertible cap, according to an embodiment of the subject invention, with the one or more front sections raised to provide a viewing aperture.
Figure 4:
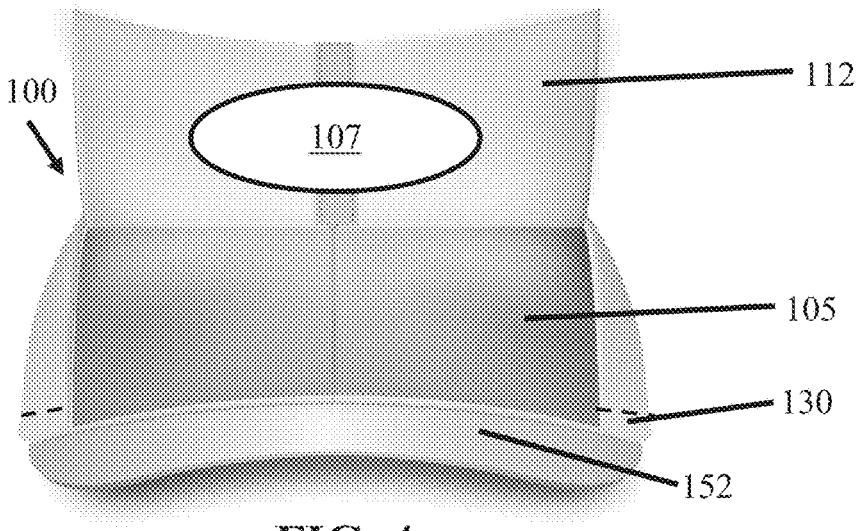
FIG. 4 illustrates a front view of a convertible cap, according to an embodiment of the subject invention, with the one more front section fully raised to be folded in position overlapping one or more rear sections of the cap.

The bottom end of the crown can be attached to a head band 130 that supports the crown on the head. The head band can extend around the bottom of the crown and can end at the left side of the visor and the right side of the visor. Alternatively, the head band can extend entirely around the bottom end of the crown and the visor can attach above or below the head band. FIG. 3 illustrates an example of a headband that extends fully around the bottom of the crown and the visor attaches below the headband. FIG. 4 illustrates an example of a head band that extends to each side of the visor, such that the head band is attached to each side of the visor. It is known in the art that various connection components 180 can be used to facilitate adjustment of a head band. Connection components can include, but are not limited to, hook and loop material, clips, snaps, zippers, pins, elastic bands, eyelets, other devices and combinations thereof. As described further below, the head band can be at least partially disconnected from the crown to form straps 210. Accordingly, the head band can include any one or more connection components that can be employed to disconnect and reattach the head band to the crown and for adjusting and securing the straps together to fit the wearer.

Figure 5:
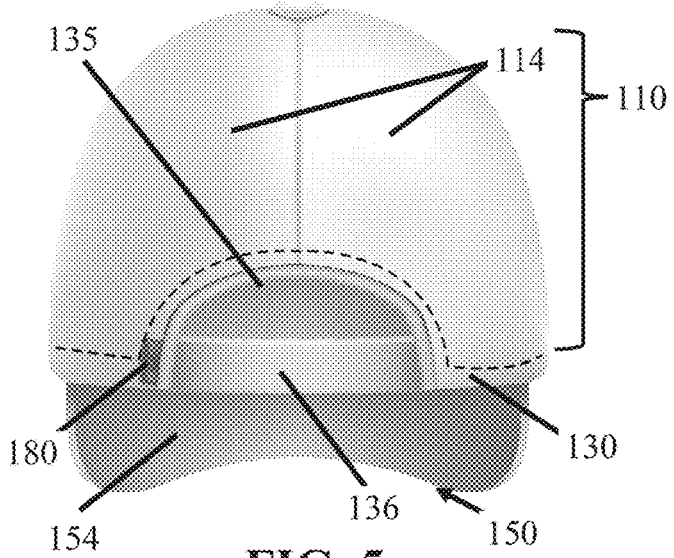
FIG. 5 illustrates a back view of a convertible cap, according to an embodiment of the subject invention, with a partially removable head band. In this embodiment, the partially removable head band goes around an adjustment cut-out in the back of the cap.

At the back of the cap, the one or more rear section can terminate to form an adjustment cut-out 135. The adjustment cut-out, such as shown in FIG. 5, can be used with an adjustment band 136 to adjust the size of the cap, by manipulating the adjustment band. The adjustment cut-out provides flexibility for changing the size of the cap, by increasing or decreasing the size of the adjustment cut-out. In one embodiment, one or more connection components 180 can be used with the adjustment band to change and maintain the sizing of a cap. In an alternative embodiment, the adjustment band is elastic so that it can conform to the head. In one embodiment, the head band 130 can extend around all or some portion of the adjustment cut-out, which is shown, in the example in FIG. 5. In an alternative embodiment, which is not shown, but would be understood by a person of skill in the art, the head band can be dually employed as an adjustment band.

Figure 6:
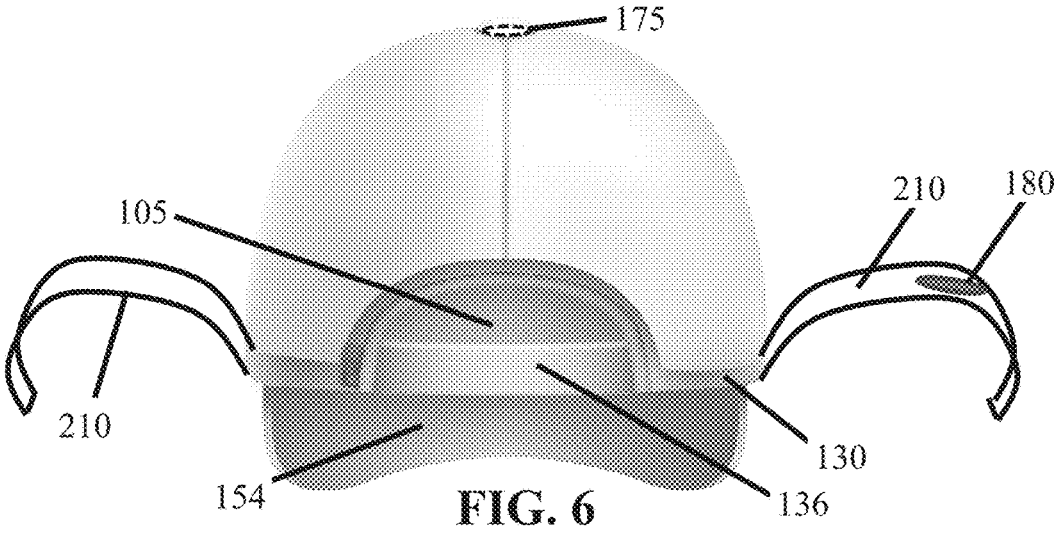
FIG. 6 illustrates a back view of a convertible cap, according to an embodiment of the subject invention, with the head band partially removed to provide straps on either side of the crown.
Figure 10:
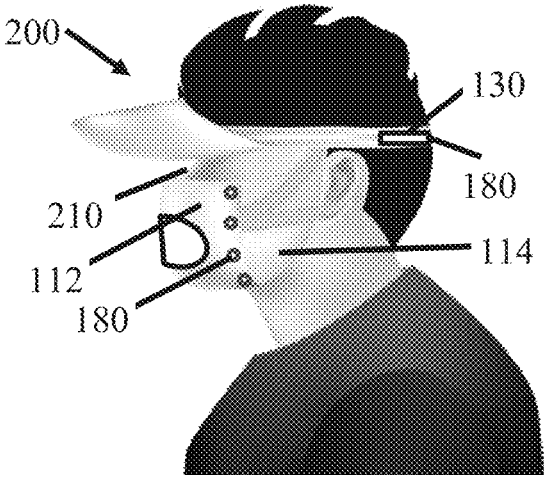

As mentioned, at least part of the head band 130 can be disconnected from the crown 110 to form two straps 210 on either side of the adjustment cut-out. When the cap is converted into a face mask 200 configuration, the straps can be secured around the head to hold the face mask on the face with the rear sections 114 covering the nose and mouth. It can be advantageous for the straps to be attached to the crown between the visor and the adjustment cut-out so that the face mask configuration can be comfortably positioned over the nose and mouth when the straps are wrapped around the head and attached. For example, the straps can attached at or near to the visor, which can position the straps above the ears when wrapped around the head, as shown, by way of example, in FIG. 10. In a further embodiment, the straps have connecting components 180 that can be used to disconnect and reconnect the straps to the crown to reform the cap. In a still further embodiment, the straps have connecting components that allow the straps to be attached together after being wrapped around the head, as discussed below. FIG. 6 illustrates one embodiment of a head band 130 that can be disconnect from the crown 110 to form straps 210 for the face mask configuration.

Figure 1B:
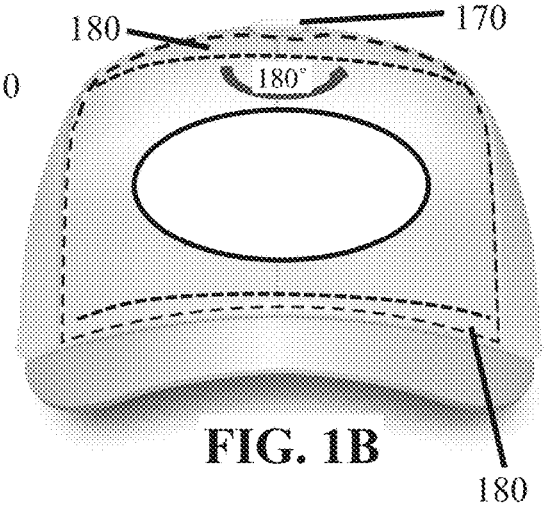

The one or more front section 112 of the crown 110 can be at least partially disconnected from the front of the cap 100. For example, the one or more front section 112 can be operably connected to the rear sections 114 and/or the visor 150 by connection components 180 that allow the front sections to be fully or partially disconnected and reconnected to the rear sections and/or the visor. FIG. 3 shows an example of connection components on either side of the one or more front sections for disconnecting and reattaching the one or more front sections to the front of the cap. In one embodiment, the one or more front section can be partially disconnected, such that the bottom and a portion of the left and right sides of the one or more front sections can be disconnected from the front of the cap. This can allow the one or more front section to be folded, bent, or flipped over the one or more rear section, so they at least partially overlap. FIGS. 3 and 4 show embodiments where the front sections are partially disconnected from the front of the cap by connecting components and are folded towards and over the top of the cap to at least partially cover the rear sections. It is also possible for the one or more front section to be completely disconnected from the front of the cap. With this embodiment, the one or more front sections are fully disconnected and can be turned or rotated, such that the top end that was at or near the breathing valve 170 is turned 180°. This allows the front sections to be placed over the rear sections 114 with that end of the front sections that was near the visor 150 to be near the adjustment cut-out 135 when placed over the one or more rear sections. One or more connecting components 180 can be arranged on the one or more front sections and/or the rear sections to facilitate attachment of the one or more front section over the rear sections. In a particular embodiment, there are also connecting components at or near the adjustment cut-out for attaching the one or more front sections under the chin. This can create a fully closed, overlapping layer on the one or more rear sections. FIG. 1B shows a non-limiting example of one or more front sections that can be fully disconnected from the front of the cap and connecting components that can be used to reattach the front sections at 180° so they go over the rear sections. Logos, decorations, or other indicia 107 can be placed on the interior of the front sections so that when flipped or pulled back, they can be seen on the front of the face mask. Where the front sections are fully disconnected, the indicia on the front of cap can be seen when the one or more front flaps are reversed over the rear sections. Such indicia can be the same or different from any indicia that may be present on the outside of the front sections.

When the one or more front section 112 are fully or partially disconnected from the front of the cap 100, there is provided a viewing aperture 210 between the visor 150 and where the front sections are folded over or are reattached to cover the one or more rear section 114. FIG. 3 shows an example of how the viewing aperture is created as the one or more front section are disconnected. As discussed above, the visor can be reconfigured to cover the viewing aperture to protect and shade the eyes when the face mask configuration is worn on the face. When the front sections are rearranged over the rear sections, as described above, the viewing aperture 210 is inhibited from extending below the nostril openings. Ideally, the viewing aperture is substantially above the nostrils, but still below the level of the eyes, when the face mask is worn. It can be further ideal for the breathing valve 170 to be in proximity to the mouth when the face mask configuration is worn. In one embodiment, the viewing area extends from the visor between approximately 20% and approximately 70% of the total distance between the visor and the breathing valve. In a further embodiment, the viewing area extends from the visor between approximately 30% and approximately 60% of the total distance between the visor and the breathing valve. In a specific embodiment, the viewing area extends from the visor approximately 50% of the total distance between the visor and the breathing valve.

Embodiments of the subject invention can be worn on the head so the crown can be above the ears and goes across about the forehead of a wearer. The visor can extend out from the crown and over the forehead and eyes to provide shade and protection. The head band can extend around the head for support and stability. The adjustment band at the back of the cap can be used to adjust the size of the cap and tension of the head band.

Figure 8:
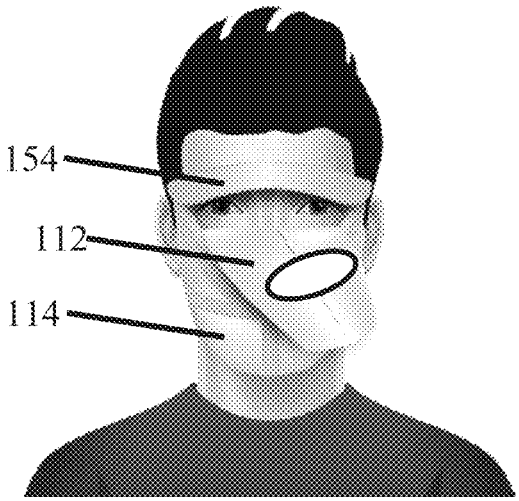
FIG. 8 illustrates a convertible cap, according to an embodiment of the subject invention, comprising one or more front sections that can fold over to overlap the one or more back sections.
Figure 9:
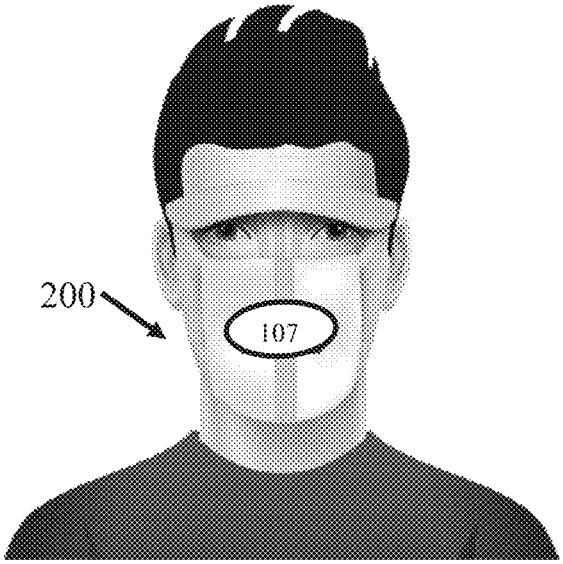
FIGS. 9 and 10 illustrate a front and side view, respectively, of a convertible cap, according to an embodiment of the subject invention, with the one or more front sections emplaced to at least partially overlap or cover the one or more rear sections (FIG. 9) and connecting components being used to reattach the one or more front sections over the one or more rear sections to create an extra layer. In the embodiment shown, the bottom end of the emplaced front sections can be further attached to the adjustment cut-out under the chin of the wearer.

To convert a cap of embodiments of the subject invention to a face mask, the various components described above can be disconnected and reattached in any order. One embodiment of a method for converting the cap 100 to a face mask 200 starts with the one or more front section 112 of the crown 110 being disconnected from the rear sections 114, as shown in FIG. 4. The front sections can be folded or flipped over to cover or overlap at least part of the one or more rear section, to create two-layers with the top of the one or more front section relocated to be in proximity to the adjustment cut-out 135, as shown in FIG. 8. If also attached to the visor 150 and/or the head band 130, the one or more front section can also be disconnected from those components, as shown in FIG. 7. In that case, the one or more front section can turned or rotated and reconnected to the rear sections 114 with connecting components 180, so that the top of the front section that was near the valve 170 is relocated towards the adjustment cut-out 135. There can be connecting components 180 strategically positioned to facilitate attachment of the one or more front section to the one or more rear section. In particular, there can be one or more connecting components at or near the adjustment cut-out for attaching the one or more front sections under the chin. A person of skill in the art will be able to determine the positions and types of connecting components used to removably attach the one or more front section to the one or more rear section.

When the one or more front section is reattached to cover at least part of the one or more rear section, there is provided a viewing aperture 210 where the one or more front panels were located. The visor 150 can be bent or flipped towards the valve, which can position the topside 152 of the visor over the viewing aperture. If necessary or desired, the visor can be temporarily reshaped to better shade and protect the viewing aperture. FIGS. 7 and 8 show a visor that has been flipped or bent over the viewing aperture.

The head band 130 can be removed to create a strap 210, on each side of the crown 110. Ideally, the strap is attached to the crown near the visor so that they can go over the ears when wrapped around the head. Once the one or more front section, visor, and headband are reconfigured, the cap has been converted to a face mask 200. The face mask can be positioned over the face so that the interior 105 of the face mask is over the nose and mouth. The one or more rear section, covered by the one or more front section, can cover the nose and mouth. This can position the viewing aperture in front of the eyes, and the visor extending out and over the eyes, across the forehead. This can also position the valve in front of the nose and mouth. The adjustment cut-out 135 and the adjustment band 136, if present, can be tucked up under the chin. This is illustrated in FIGS. 7, 8, 9 and 10. The method can be reversed to reconfigure the face mask as a cap.

It seems likely that it will be necessary or even desirable in the future to wear a protective face mask in certain situations. The ability to conveniently carry or have on hand a face mask can increase the likelihood of their use by the public. Caps of embodiments of the subject invention provide a unique and convenient option for keeping a face mask on hand and quickly accessible. The convertible cap is advantageously useful in either configuration as a cap or face mask. The material of the cap can also be such that it is capable of being cleaned and/or subjected to antimicrobial treatments.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. A head garment comprising a cap configuration having a crown and a headband configured to be disconnected from each other and reconnected to each other to provide a face mask configuration, adapted to be securable over a nose and a mouth of a wearer for breathing, the head garment further comprising a valve.

2. The head garment, according to claim 1, the crown and the headband being at least partially disconnectable and reconnectable to provide the face mask configuration having a viewing aperture, configured to be placed in front of eyes of the wearer, and straps formed from the headband and configured to secure the face mask configuration over the nose and the mouth.

3. The head garment, according to claim 2, further comprising at least one front section that is at least partially disconnectable from a front of the cap configuration of the head garment and configured to be placed over at least one rear section to provide the viewing aperture.

4. The head garment, according to claim 2, further comprising a visor having a topside and an underside that can be reversed in position when the cap configuration is configured as the face mask configuration to provide a visor over the viewing aperture.

5. The head garment, according to claim 1, further comprising at least one connecting component that facilitates disconnection and reconnection of the cap configuration into the face mask configuration and that facilitates disconnection and reconnection of the face mask configuration into the cap configuration.

6. A cap configurable as a face mask, the cap comprising:

a crown comprising at least one front section being disconnectable for overlapping at least one rear section of the crown and providing a viewing aperture;

a head band around and disconnectable from a bottom of the crown to provide straps;

a visor having a topside and a bottomside and arranged below the at least one front section; and a valve at a top of the cap.

7. The cap according to claim 6, the at least one front section being at least partially removable from a remainder of the crown such that the at least one front section flips over the at least one rear section.

8. The cap according to claim 7, the at least one front section being completely removable from the remainder of the crown and reattachable over the at least one rear section.

9. The cap according to claim 8, the valve being a one-way breathing valve.

10. A method for converting a cap to a face mask, the method comprising:

providing a cap configurable as a face mask, the cap comprising:

a crown comprising at least one front section being at least partially disconnectable for at least partially overlapping at least one rear section of the crown and providing a viewing aperture;

a head band at least partially around and at least partially disconnectable from a bottom of the crown to provide straps;

a visor having a topside and a bottomside and arranged below the at least one front section; and a valve at a top of the cap;

disconnecting the at least one front section at least partially from the at least one rear section to provide the viewing aperture;

positioning the at least one front section to at least partially cover the at least one rear section;

disconnecting the headband from the crown to provide the straps for securing around a head of a wearer;

bending or rotating the visor towards the viewing aperture, such that when the cap is converted to the face mask, the face mask is worn with the viewing aperture in front of eyes of the wearer and the visor extending over the viewing aperture, with the overlapping at least one front section and at least one rear section positioned over a nose and a mouth of the wearer and the valve in front of the nose and the mouth.

11. The method according to claim 10, the disconnecting of the at least one front section at least partially from the at least one rear section comprising partially disconnecting the at least one front section from the at least one rear section and folding the at least one front section to overlap the at least one rear section.

12. The method according to claim 10, the disconnecting of the at least one front section at least partially from the at least one rear section comprising completely disconnecting from the one or more rear section, and the method further comprising reconnecting the at least one front section to overlap the at least one rear section.

13. The method according to claim 10, the valve being a one-way breathing valve.

14. The method according to claim 13, the disconnecting of the headband from the crown to provide the straps comprising disconnecting the headband from the crown to form the straps that are attached to the crown such that, when secured to the head, the straps are above ears of the wearer.

15. The method according to claim 14, further comprising:

reattaching the straps to the bottom of the crown to reform the headband;

disconnecting the at least one front section from overlapping the at least one rear section;

reconnecting the at least one front section to the at least one rear section to close the viewing aperture; and bending or rotating the visor to extend out from the reconnected at least one front section, such that the face mask is converted back to the cap.

16. The method according to claim 15, the reconnecting of the at least one front section to the at least one rear section to close the viewing aperture comprising folding the at least one front section over the viewing aperture.

17. The method according to claim 15, the reconnecting of the at least one front section to the at least one rear section to close the viewing aperture comprising completely disconnecting the at least one front section and reconnecting the at least one front section to cover the viewing aperture.

18. The method according to claim 15, the straps overlapping an adjustment cut-out and being used to adjust a size of the cap.

19. The method according to claim 10, further comprising treating the cap with an anti-microbial agent.

* * * * *